US006471540B1

(12) United States Patent
Fernandez

(10) Patent No.: US 6,471,540 B1
(45) Date of Patent: Oct. 29, 2002

(54) ELECTROLUMINESCENT JUMPER CABLES

(76) Inventor: Robert Fernandez, 10301 NW. 108th Ave., Miami, FL (US) 33178

( * ) Notice: Subject to any disclaimer, the term of this patent is extended or adjusted under 35 U.S.C. 154(b) by 0 days.

(21) Appl. No.: 09/883,047

(22) Filed: Jun. 18, 2001

(51) Int. Cl.[7] ..... H01R 3/00
(52) U.S. Cl. ..... 439/490; 439/504
(58) Field of Search ..... 439/490, 504

(56) References Cited

U.S. PATENT DOCUMENTS 3,942,859 A * 3/1976 Korodi ..... 439/490
4,272,142 A * 6/1981 Zapf ..... 439/490
4,420,212 A * 12/1983 Wright ..... 439/490
4,938,712 A * 7/1990 Black ..... 439/490
4,969,834 A * 11/1990 Johnson ..... 439/490
5,230,637 A * 7/1993 Weber ..... 439/504
5,434,013 A 7/1995 Fernandez
5,566,384 A 10/1996 Chien
5,666,453 A 9/1997 Dannenmann
5,917,288 A 6/1999 Feldman
5,955,957 A 9/1999 Calabrese
6,123,576 A 9/2000 James

* cited by examiner

*Primary Examiner*—Brian Sircus
*Assistant Examiner*—Hae Moon Hyeon
(74) *Attorney, Agent, or Firm*—Alvin S. Blum

(57) ABSTRACT

A jumper cable assembly has a pair of clamps at both ends for parallel connection to a weak and a strong battery for starting a motor. Along the side of the assembly is mounted an elongate, flexible electroluminescent element that is powered when either end of the assembly is connected to a battery. The assembly lights up along its length to thereby avoid tripping over it when it is being used in the dark.

7 Claims, 3 Drawing Sheets

ELECTROLUMINESCENT JUMPER CABLES

This invention relates to apparatus for safe operation of jumper cables, and more particularly to a jumper cable assembly that provides an elongate electroluminescent element alongside the cable.

BACKGROUND OF THE INVENTION

Jumper cables are employed to start a motor when the vehicle battery is too weak by connecting a more powerful battery in parallel with the weak battery. This may take place in the dark. Moving around in the dark between two vehicles to connect the two batteries, and to then enter the vehicle to start the motor while the cables are in place can be dangerous. If one trips over the cable, the connections may pull loose and cause sparking, bums, and fires.

U.S. Pat. No. 6,123,576 issued Sep. 26, 2000 to James discloses safety jumper cables that ensure correct connections, but do not address the problem of tripping over the cables in the dark.

U.S. Pat. No. 5,434,013 issued Jul. 18, 1995 to the applicant discloses an elongate electroluminescent strip connected to an electric power source for application to an automobile to provide an illuminated trim.

U.S. Pat. No. 5,917,288 issued Jan. 29, 1999 to Feldman discloses an elongate, flexible cable connected to the audio output of an audio amplifier. It is illuminated along its length by an electroluminescent element that glows in time to the music.

None of the prior art teach luminescent jumper cables.

It would be useful to have a set of jumper cables that would be luminous along their length so that people would be less likely to trip over them in the dark

SUMMARY OF THE INVENTION

It is accordingly an object of the invention to provide a jumper cable assembly that has the usual connections at both ends for connecting two batteries in parallel. It is another object that the assembly emit light along its length when it is connected to at least one of the batteries. The jumper cables of the invention include a power supply that is connected to the positive and negative wires, so that it will be powered when either battery is connected. A flexible, elongate, electroluminescent element is connected to the power supply output and disposed alongside the positive and negative wires to thereby illuminate the cable assembly along its length.

The jumper cable assembly may optionally include a talking feature to ensure correct polarity of connection. When the negative and positive connections are reversed at a battery, a sensor may detect the error and the reversed connections may power an audible signal such as "wrong connection".

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
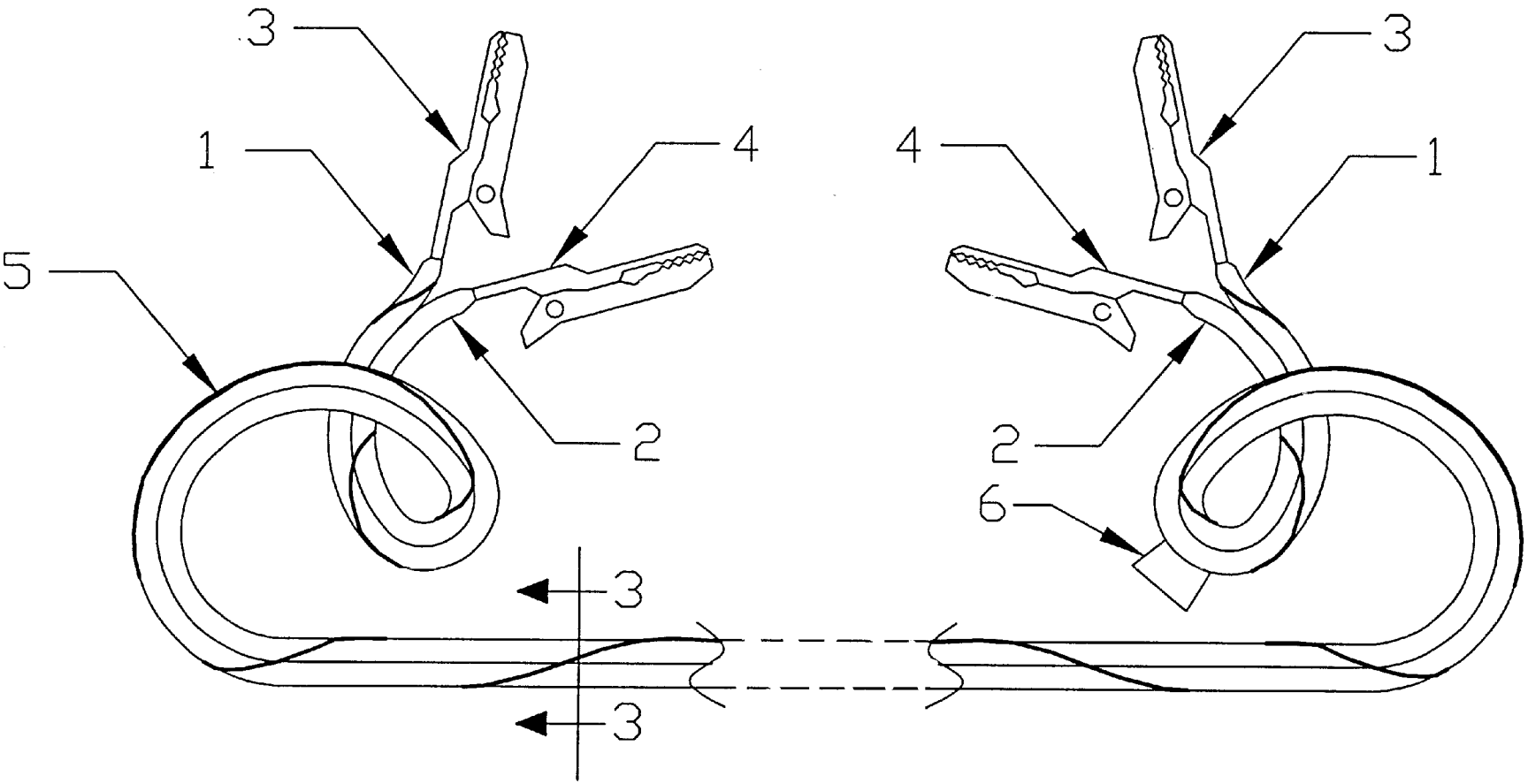
FIG. 1 is a perspective view of the jumper cable assembly of the invention.
Figure 2:
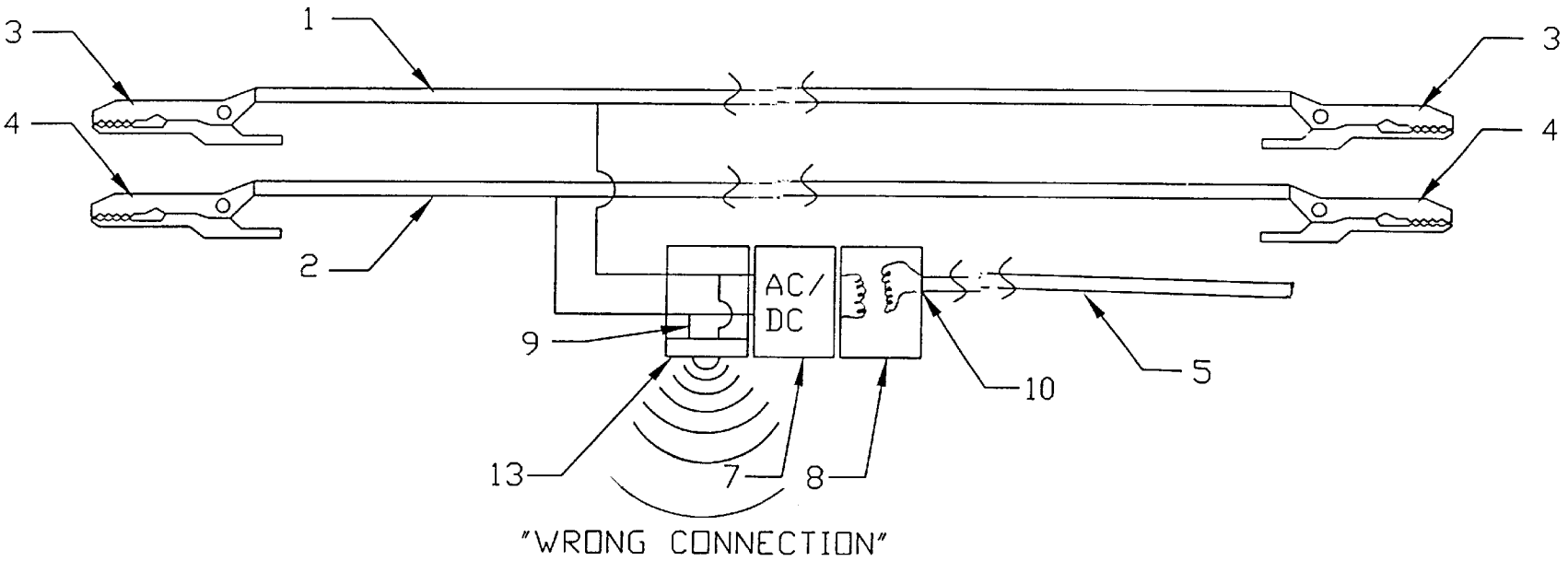
FIG. 2 is a schematic diagram of the assembly of the invention.
Figure 3:
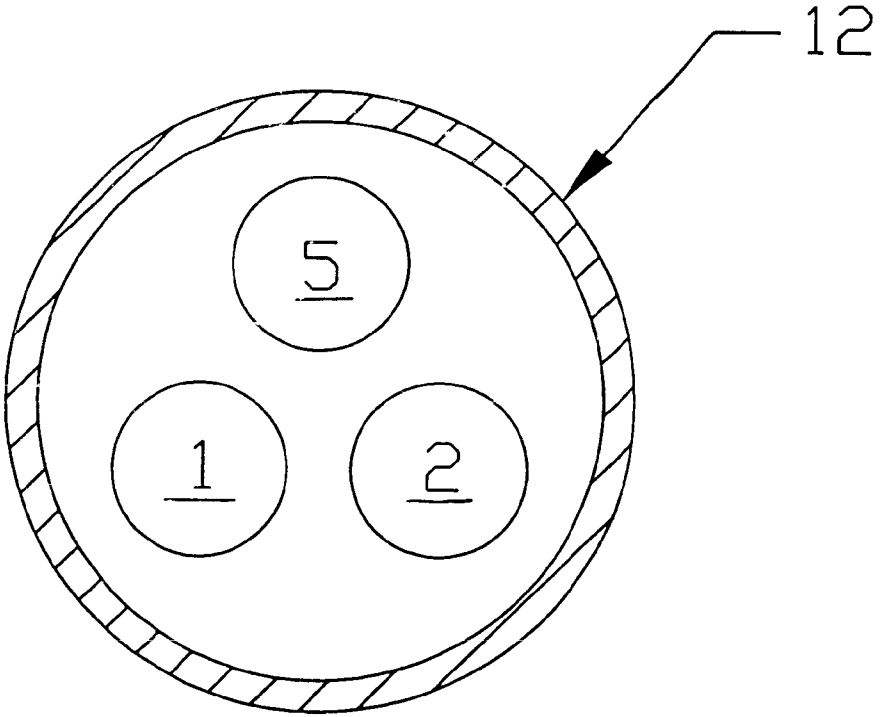
FIG. 3 is a cross sectional view taken through line 3—3 of FIG. 1.

Referring now to the drawings, the jumper cable assembly 11 of the invention includes an elongate, flexible positive wire 1 with clamps 3 at both ends for clamping onto the positive posts of a weak and a strong battery, and an elongate, flexible negative wire 2 with clamps 4 at both ends for connection to the weak and the strong batteries. The preceding structure may be conventional. In addition, the assembly includes an elongate flexible electroluminescent element 5 attached to the wires, and extending along a major portion of the wires. It may be attached to the wires by various well known means such as enclosing the wires and the element 5 in a transparent plastic sleeve 12, for example. It may be wound on the positive and negative wires in a spiral configuration to be visible from any angle. Wires 1 and 2 are connected to the input 9 of power supply 6. There a dc to ac converter 7 converts the battery power to alternating current, which is converted to a high voltage by transformer 8. The high voltage output 10 powers electroluminescent element 5. Whenever either battery is connected to the assembly, the element will emit light from a majority of the length of the assembly to avoid tripping over it. The power required by the element 5 is so low that even the weak battery will light it.

Power supply housing 6 may optionally include an audible signal generator 13 that is activated only when wire 2 has a positive voltage on it and wire 1 has a negative voltage on it. While I have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A flexible jumper cable assembly comprising:

a) an elongate positive wire having battery connections at both ends;

b) an elongate negative wire having battery connections at both ends;

c) an elongate, flexible electroluminescent element disposed alongside the positive and negative wires to move therewith; and d) an electroluminescent power supply having an input connected to the negative and positive wires and an output connected to the electroluminescent element at one end thereof to cause the electroluminescent element to emit light along its length to thereby illuminate the assembly when a battery is connected to the positive and negative wires.

2. The jumper cable assembly according to claim 1 in which the electroluminescent element is spirally wound on the wires.

3. The jumper cable assembly according to claim 1 further comprising an audible signal generator that emits an audible signal when the wires are incorrectly connected to the battery.

4. A flexible jumper cable assembly comprising:

a) an elongate, continuous positive wire of a particular length having a battery connection at each end;

b) an elongate, continuous negative wire of substantially the same particular length having a battery connection at each end;

c) an elongate flexible electroluminescent element disposed along a major portion of the positive and negative wires to move with the positive and negative wires and to emit light along its length when electric power is applied to one end; and d) an electroluminescent power supply having an input connected to the negative and positive wires and an output connected to one end of the electroluminescent element to thereby illuminate a major portion of the assembly when at least one battery is connected to the positive and negative wires.

5. The jumper cable assembly according to claim 4 in which the electroluminescent element is spirally wound on the wires.

6. The jumper cable assembly according to claim 5 further comprising an audible signal generator that emits an audible signal when the wires are incorrectly connected to the at least one battery.

7. The jumper cable assembly according to claim 4 further comprising an audible signal generator that emits an audible signal when the wires are incorrectly connected to the at least one battery.

* * * * *